US005393353A

United States Patent [19]

Bishop

[11] Patent Number: 5,393,353

[45] Date of Patent: Feb. 28, 1995

[54] CHROMIUM-FREE BLACK ZINC-NICKEL ALLOY SURFACES

[75] Inventor: Craig V. Bishop, Lakewood, Ohio

[73] Assignee: McGean-Rohco, Inc., Cleveland, Ohio

[21] Appl. No.: 122,393

[22] Filed: Sep. 16, 1993

[51] Int. Cl.[6] ..... C23C 22/07

[52] U.S. Cl. ..... 148/253

[58] Field of Search ..... 148/253

[56] References Cited

U.S. PATENT DOCUMENTS

| | | | |
|---|---|---|---|
| 3,501,352 | 3/1970 | Shah | 148/6.2 |
| 3,535,168 | 10/1970 | Thompson | 148/6.16 |
| 3,615,892 | 10/1968 | Heizelman | 148/203 |
| 3,647,569 | 3/1972 | Schneider | 148/6.16 |
| 3,932,198 | 1/1976 | Schneider | 148/6.2 |
| 4,026,728 | 5/1977 | Yoshida et al. | 148/6.14 R |
| 4,141,758 | 2/1979 | Glassman et al. | 148/6.2 |
| 4,171,231 | 10/1979 | Bishop et al. | 148/6.21 |
| 4,263,059 | 4/1981 | Guhde et al. | 148/6.2 |
| 4,407,899 | 10/1983 | Hara et al. | 428/626 |
| 4,411,964 | 10/1983 | Hara et al. | 428/626 |
| 4,578,122 | 3/1986 | Crotty | 148/6.2 |
| 4,657,599 | 4/1987 | Sutherland | 148/6.2 |
| 4,689,085 | 8/1987 | Plueddemann | 106/287.14 |
| 5,001,011 | 3/1991 | Plueddemann | 428/447 |
| 5,073,456 | 12/1991 | Palladino | 428/446 |
| 5,101,055 | 3/1992 | Dinh et al. | 556/413 |
| 5,108,793 | 4/1992 | von Doij et al. | 427/327 |

FOREIGN PATENT DOCUMENTS

| | | |
|---|---|---|
| 586517 | 3/1947 | United Kingdom . |
| 1461244 | 1/1977 | United Kingdom . |

OTHER PUBLICATIONS

Fields, "The Chemical Coloring of Metals" 1927 pp. 206–209.

*Primary Examiner*—Sam Silverberg
*Attorney, Agent, or Firm*—Renner, Otto, Boisselle & Sklar

[57] ABSTRACT

A method is described for preparing a black zinc-nickel alloy surface containing at least about 8% nickel in the alloy. The method of the invention comprises contacting said surfaces with a chromium-free aqueous acidic solution of an inorganic acid. Preferably the inorganic acid is a phosphorus acid selected from phosphoric acid, phosphorous acid, hypophosphorous acid, and mixtures thereof. The aqueous acidic solution can also contain at least one silane. Metal articles having zinc-nickel alloy surfaces containing at least about 8% nickel in the alloy which have been treated in accordance with the method of the invention exhibit the desired blackened surfaces and are characterized by improved corrosion resistance when at least one silane is present in the acidic solution.

8 Claims, No Drawings

CHROMIUM-FREE BLACK ZINC-NICKEL ALLOY SURFACES

FIELD OF THE INVENTION

The present invention relates to a method of preparing chromium-free black zinc-nickel alloy surfaces, and to articles having such surfaces. More particularly, the invention relates to a process for preparing chromium-free black zinc-nickel alloy surfaces containing at least about 8% nickel in the alloy. The invention also relates to metal articles having such blackened surfaces.

Black conversion coatings containing hexavalent chromium are known. One known acidic solution comprises chromic acid, silver nitrate and acetic acid. The black color results from the incorporation of the silver ion into the passivation coating. However, in view of the use of the photosensitive silver ion, the black color may "fade" under illumination at certain frequencies of light, to a green or olive drab color which in many instances is unappealing. Moreover, the costs associated with treatments involving hexavalent chromium and silver are expensive.

One disadvantage of chromium type solutions particularly those containing hexavalent chromium, is in the area of waste disposal. Emphasis on water pollution problems has drawn attention to the fact that chromates are serious pollutants. In order to satisfy water quality standards, it frequently is necessary to subject the waste water to a multi-stage purification sequence in order to remove chromates from the effluents. Typical steps in the sequence include the reduction of any hexavalent chromium to trivalent chromium and precipitation with, for example, lime. This precipitation results in a reduction in the chromate content of the effluent water but the process is quite expensive, and the precipitate creates a disposal problem.

SUMMARY OF THE INVENTION

A method is described for preparing a chromium-free black zinc-nickel alloy surface containing at least about 8% nickel in the alloy. The method of the invention comprises contacting said surfaces with a chromium-free aqueous acidic solution of an inorganic acid. Preferably the inorganic acid is a phosphorus acid selected from phosphoric acid, phosphorous acid, hypophosphorous acid, and mixtures thereof. The aqueous acidic solution can also contain at least one silane. Metal articles having zinc-nickel alloy surfaces containing at least about 8 % nickel in the alloy which have been treated in accordance with the method of the invention exhibit the desired blackened surfaces and are characterized by improved paint adhesion when a silane is present in the acidic solution.

DESCRIPTION OF THE PREFERRED EMBODIMENTS

The method of the present invention is useful in preparing black zinc-nickel alloy surfaces, and more particularly, black zinc-nickel alloy surfaces containing at least about 8% nickel in the alloy. The alloys may contain up to about 20% of nickel. Specific examples of zinc-nickel alloys which can be provided with a black chromium-free containing conversion coating include zinc-nickel alloys containing 10% nickel, zinc-nickel alloys containing 12% nickel, zinc-nickel alloys containing 16% nickel, etc.

The chromium-free aqueous acidic solutions which are useful in the method of the present invention contain an inorganic acid such as sulfuric acid, nitric acid, hydrochloric acid, a phosphorus acid selected from phosphoric acid, phosphorous acid, hypophosphorous acid, and mixtures thereof. In one presently preferred embodiment, the acid is a phosphoric acid and more particularly, phosphoric acid or hypophosphorus acid. Dilute aqueous solutions of the acids are sufficient to provide the desired black surface, and aqueous solutions containing from 1% to about 10% or 20% by weight of the acid are sufficient. For example, the following aqueous solutions may be utilized in the method of the invention: 5% $H_2SO_4$, 8% $H_2SO_4$, 5% $HNO_3$, 5% HCl, 5% $H_3PO_4$, 5% $H_3PO_3$, 8% $H_3PO_2$, etc.

The aqueous acidic solutions of the present invention may also contain at least one silane. When the aqueous acidic solution utilized in the present invention contains a silane in addition to the inorganic acid, the resulting black zinc-nickel alloy surface exhibits improved paint adhesion.

The silanes which may be incorporated into the aqueous acidic solutions used in the present invention may be characterized by the formula $$(R^1)_a(RO)_bSi(R^2)_c \qquad (I)$$

wherein each R is independently an alkyl, aryl, arylalkyl or a cycloalkyl group, each $R^1$ is an R group or hydrogen, $R^2$ contains from 1 to about 10 carbon atoms and one or more functional groups selected from the groups consisting of halogen, vinyl, epoxy, acryl, styryl, amino, carboxyl, amide or sulfonyl groups, a is an integer of from 0 to 3, b is an integer from 0 to 3, c is an integer from 1 to 3, and the sum of $a+b+c=4$.

The silanes described by Formula I can contain from 0 to 3 organooxy substituents where the organic portion of the organooxy substituent is denoted as RO. Each R can be independently selected from the group consisting of alkyl, aryl, aralkyl and cycloalkyl groups containing less than about 20 carbon atoms. Each R can be, for example, methyl, ethyl, propyl, isopropyl, butyl, t-butyl, isobutyl, pentyl, dodecyl, phenyl, tolyl, xylyl, benzyl, cyclopentyl or cyclohexyl groups.

The silanes described by Formula I can also contain from 0 to 3 substituents identified as $R^1$, wherein each $R^1$ is independently chosen from the group consisting of R or hydrogen. In one embodiment, R and $R^1$ are alkyl or alkoxy alkyl groups, and more often, alkyl groups containing from 1 to 5 carbon atoms. Examples of $R^1$ groups include $CH_3$, $C_2H_5$, $-CH_2OCH_3$ and $CH_2CH_2OCH_3$.

The silanes described by Formula I also contain from 1 to 3 substituents identified as $R^2$ wherein $R^2$ contains from 1 to about 10 carbon atoms and one or more functional groups selected from the groups consisting of halogen, vinyl, epoxy, acryl, styryl, amino, carboxyl, amide or sulfonyl groups. Specific examples of the $R^2$ group include groups such as those characterized by the formulae $$-C(R^4)=CH_2,$$

$$-(CH_2)_nNH_2,$$

$$-(CH_2)_nX,$$

$$-(CH_2)_nNH(CH_2)_mNH_2,$$

$-(CH_2)_nOC(O)C(R^4)=CH_2$, $-(CH_2)_2NH(CH_2)_2NH_2$, $-(CH_2)_nNH(CH_2)_nN(H)(CH_2)_nArCH=CH_2$, and

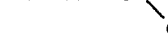

wherein $R^4$ is hydrogen or a methyl or ethyl group, X is a halogen, particularly chlorine or a COOH, $CONH_2$, or $SO_3H$ group. Ar is an arylene group, particularly a phenylene group, and m and n are each independently integers of from 1 to about 5.

In the silanes represented by Formula I, a is an integer of from 0 to 3, b is an integer of from 0 to 3, and c is an integer of from 1 to 3. The sum of a b+c=4. In one preferred embodiment c=1. In another embodiment a =0, b=3, and c=1.

The silanes which may be utilized in the method of the present invention also may be characterized by the formula $$(R^1)_a(RO)_{3-a}SiR^2 \quad \text{(IA)}$$

wherein R and $R^1$ are each independently alkyl groups containing from 1 to about 5 carbon atoms, $R^2$ contains from about 1 to about 10 carbon atoms and one or more functional groups selected from the groups consisting of halogen, vinyl, epoxy, acryl, styryl, amino, carboxyl, amide or sulfonyl groups, and a is an integer of from 0 to 3.

The groups R and $R^1$ in Formula IA are each independently alkyl groups containing from 1 to about 5 carbon atoms. Preferably, R and $R^1$ are each independently methyl or ethyl groups. The $R^2$ groups in the silanes represented by Formula IA may be any of the $R^2$ groups illustrated above with regard to Formula I.

In the silane represented by Formula IA, there is one $R^2$ group, and there may be 0 to 3 $R^1$ and RO groups provided that the sum of the $R^1$ and the RO groups equals 3. In one preferred embodiment, a=0.

Specific examples of silanes of Formula I and IA which are useful in the method of the present invention include:

$CH_3(CH_3O)_2SiCH=CH_2$ $(CH_3O)_3Si\text{-}CH=CH_2$ $(CH_3O)_3Si\text{-}C(CH_3)=CH_2$ $(CH_3OCH_2CH_2O)_3SiCH=CH_2$ $(CH_3O)_3Si(CH_2NH_2$ $(C_2H_5O)_3Si(CH_2)_3NH_2$ $(CH_3O)_3Si(CH_2)_3NHCH_2CH_2NH_2$ $(CH_3O)_3SiCH_2CH_2CH_2Cl$ $(CH_3O)_3SiCH_2CH_2COOH$ $(CH_3O)_3SiCH_2CH_2SO_3H$ $(CH_3O)_3Si(CH_2)_3OC(O)CH=CH_2$ $(CH_3O)_3Si(CH_2)_3OC(O)C(CH_3)=CH_2$ $(CH_3O)_3\text{-}Si(CH_2)_3NH(CH_2)_2NHCH_2C_6H_4CH=CH_2$

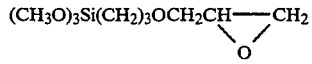

Many of the above-described silanes are available commercially from Union Carbide and Dow Coming. The silanes of Formula I wherein $R^2$ contains an acid group such as —COOH or —$SO_3H$ are described in U.S. Pat. No. 5,001,011 (Pleuddemann), and the disclosure of this patent relating to such silanes is hereby incorporated by reference.

In addition to the silane of Formula I, the chromium-free aqueous acidic solutions utilized in the present invention may also contain from about 0.1% to 5%, preferably 0.5% to 2% by weight of at least one silane characterized by the formulae $$((R^1)_a(RO)_{3-a}SiR^3)_yN(H)_{3-y} \quad \text{(II)}$$

$$((R^1)_a(RO)_{3-a}Si)_2R^3 \quad \text{(m)}$$

wherein each R is independently an alkyl, aryl, aralkyl or a cycloalkyl group, each $R^1$ is an R group, an alkenyl or fluoride-substituted alkyl group containing less than about 20 carbon atoms, or hydrogen, each $R^3$ is a divalent hydrocarbon or divalent polyether group of less than 20 carbon atoms, a is an integer of from 0 to 3, and y is an integer of from 1 to 3.

The silanes represented by Formula II may be mono-, his-, or tris-(silyl organo)amines. That is, y may be 1, 2 or 3. Silanes of the type represented by Formula II are described in more detail in U.S. Pat. No. 5,101,055 (Dinh et al), and the disclosure of this patent with regard to silyl organo amines of the type represented by Formula II is hereby incorporated by reference.

Each R in Formula II can be independently selected from the groups consisting of alkyl, aryl, aralkyl and cycloalkyl groups containing less than 20 carbon atoms. Examples of R include methyl, ethyl, propyl, isopropyl, butyl, t-butyl, isobutyl, pentyl, dodecyl, phenyl, tolyl, xylyl, benzyl, cyclopentyl and cyclohexyl groups. Each $R^1$ group in Formula II is independently $R^1$, an alkenyl group of less than 20 carbon atoms, a fluoride-substituted alkyl group of less than 20 carbon atoms or hydrogen. The alkenyl group can be, for example, vinyl or allyl, the fluoride-substituted alkyl group can be, for example, 3,3,3-trifluoropropyl or perfluoropropyl groups.

The $R^3$ group in Formula II is a divalent hydrocarbon group or a divalent polyether group of less than 20 carbon atoms. $R^3$ can be, for example, alkylenes such as methylene, ethylene, propylene, ethylidene; cycloalkenes such as cycloheptylene and cyclohexylene; or divalent aromatic groups such as phenylene, tolylene, xylylene and napthylene. $R^3$ can also be, for example, a divalent polyether of the formula $$-R^5(OR^6)_z-$$

wherein $R^5$ and $R^6$ are each independently alkylene groups and z is an integer of from 1 to 5. The divalent polyether group can be, for example, a diethylene ether group.

Preferred amines described by Formula II are those where R is methyl, ethyl or phenyl, more preferably methyl or ethyl, $R^1$ methyl or ethyl, and $R^3$ is an alkylene group of from 1 to 3 carbon atoms. Examples of such amines represented by Formula II include mono(-trimethoxysilylpropyl)amine; mono(vinyl-dimethoxysilylpropyl)amine; mono(3,3,3-trifluoropropyl-dimethoxysilylpropyl)amine, bis(trimethoxysilylpropyl)amine, bis(methyldimethoxysilylpropyl)amine; tris(-trimethoxysilylethyl)amine; and tris(triethoxysilylpropyl)amine.

The disilyl compounds represented by Formula III above are described in more detail in U.S. Pat. Nos. 4,689,085 (Plueddemann) and 5,073,456 (Palladino), and disclosures of both of these patents relating to the disilyl compounds of the types represented by Formula III are hereby incorporated by reference. The definition and examples of the R and $R^1$ groups are the same as those which are presented above with regard to Formula II. $R^3$ is a divalent hydrocarbon or divalent polyether group containing less than about 20 carbon atoms, and a is an integer of from 0 to 3.

Preferably the R groups and $R^1$ groups in Formula III are alkyl groups containing from 1 to about 8 carbon atoms, and more often, R and $R^1$ are methyl or ethyl groups. $R^3$ preferably is a divalent hydrocarbon group containing from 1 to about 3 or 4 carbon atoms such as methylene, ethylene, propylene, butylene, etc.

As noted above, a in Formula III is an integer of from 0 to 3. In one preferred embodiment, a is 0. Examples of disylyl compounds of Formula III which are useful in the present invention in combination with the silanes of Formula I include:

$(CH_3O)_3Si(CH_2)_2Si(OCH_3)_3$, $(CH_3O)_3Si(CH_2)_3Si(OCH_3)_3$, $(C_2H_5O)_3Si(CH_2)_3Si(OC_2H_5)_3$, $(CH_3O)_3Si(CH_2)_6Si(OCH_3)_3$, and $(CH_3O)_3SiC_6H_4Si(OCH_3)_3$(meta).

The chromium-free aqueous acidic solutions which contain a silane generally will comprise water, from about 1% to about 10% by weight of an inorganic acid, and from about 0.1% to about 10%, more often from about 1% to about 5% by weight of at least one silane. The pH of such solutions generally are in the range of about 1.0 to about 3.0.

The following examples illustrate the aqueous acidic solutions containing silanes which are useful in the method of the present invention. Unless otherwise indicated in the following examples and elsewhere in the specification and claims, all parts and percentages are by weight, temperatures are in degrees Centigrade, and pressure is at or near atmospheric pressure.

EXAMPLE 1

| Component | Amount |
|---|---|
| N-(2-aminoethyl)-3-aminopropyltrimethoxy silane | 3.0% w |
| $H_3PO_2$ | 2.8% w |
| Water | 94.2% w |

EXAMPLE 2

| | |
|---|---|
| Silane of Example 1 | 30 ml/l |
| $H_3PO_4$ | to pH of 2.0 |
| Water | 1 liter |

EXAMPLE 3

| | |
|---|---|
| 3-methacryloxypropyl trimethoxy silane | 2% w |
| $H_3PO_4$ | 4% w |
| Water | 94% w |

EXAMPLE 4

| | |
|---|---|
| Vinyl trimethoxy silane | 4% w |
| $H_2SO_4$ | 3% w |
| Water | 93% w |

EXAMPLE 5

| | |
|---|---|
| N-(2-aminoethyl)-3-aminopropyltrimethoxy silane | 3.0% w |
| $H_3PO_4$ (85%) | 2.8% w |
| 1,2-bis(trimethoxysilyl)ethane | 1.0% w |
| water | 93.2% w |

EXAMPLE 6

| | |
|---|---|
| N-(2-aminopropyl)-3-aminopropyltrimethoxy silane | 3.0% w |
| $H_3PO_4$ (85%) | 2.8% w |
| tris(trimethoxysilylethyl)amine | 1.0% w |
| water | 93.2% w |

In the method of the present invention, the zinc-nickel surface usually is cleaned by chemical and/or physical means to remove any grease, dirt or oxides, although such treatments are not always required, particularly when the surface is to be treated with the aqueous acidic solutions immediately or soon after the zinc-nickel alloy has been deposited on a metallic substrate. After rinsing the surface with water, the surface is contacted with the aqueous acidic solutions of the present invention. Contact may be accomplished by any of the commonly used techniques such as dipping, spraying, brushing, roller-coating, reverse roller-coating and flow coating. The aqueous acidic solutions are particularly useful in dipping operations. The aqueous acidic solutions are generally maintained at a temperature of from about 10° C. to about 50° C. and more often from about 20°–35° C. or about ambient temperature. When the method of application is by dipping or immersion, a dipping or immersion time of about 10 to about 60 seconds, more often from about 15 to about 25 seconds is sufficient.

Following the treatment with the aqueous acidic solution, the metal surface may be rinsed with water and then dried. Drying may be effected by air-blowing at room temperature or at higher temperatures, usually up to about 65° C.

The coating produced on the zinc-nickel alloy surface in accordance with the method of the present invention is black in color, and this black color is desirable for color coding of parts, for providing black surfaces in devices which require the absence of reflected fight, in providing light absorbent surfaces for devices such as passive solar collectors, and for providing black surfaces for use in automated optical inspection (AOI) where the contrast between shiny deposits and the black coating are easy to discern using AOI equipment. In addition to furnishing the desired black surface, the aqueous acidic compositions containing trivalent chromium and a phosphorus acid provide improved corrosion resistance and paint adhesion.

The following examples illustrate the method of treating zinc-nickel surfaces with the chromium-free aqueous acidic compositions containing a silane.

Example I

Steel panels freshly plated with a zinc-nickel alloy containing about 10% nickel in the alloy are immersed in a 10% phosphoric acid solution for about 15 seconds while maintaining the temperature of the solution at about 21° C. (70° F). The panels are removed from the solution, rinsed with cold water and allowed to dry at room temperature. The panels are now black in color.

Example II

The general procedure of Example I is repeated except that the aqueous acidic solution of Example 1 is used and the panels are immersed for about one minute. A black surface is obtained.

Example III

The general procedure of Example I is repeated except that the aqueous acidic solution of Example 2 is used. A black surface is obtained.

After a metal article has been treated in accordance with the method of the present invention, an organic coating composition can be applied over the black surface. The organic coating composition may be a siccative coating such as a paint, lacquer, varnish, synthetic resin, or enamel, or an electrostatically deposited powder coating. Examples of siccative coatings which may be used are the acrylic, alkyd, epoxy, phenolic, melamine and polyvinyl alcohol resins and paints.

Application of a siccative coating composition can be effected by any of the ordinary techniques such as brushing, spraying, dipping, roller-coating, flow-coating, electrostatic or electrophoretic attraction. The coated article is dried in a manner best suited for the siccative coating composition employed such as by air-drying at ambient or elevated temperature, baking in an oven, or baking under infra-red lamps. In most instances, the thickness of the dried film of the siccative organic coating composition will be from about 0.1 to about 10 mils, and more often between 0.3 to about 5 mils.

It has been observed that contact of a zinc-nickel alloy surface containing at least about 8% nickel with the aqueous acidic solutions containing at least one silane results in a black surface which exhibits improved paint adhesion. Improved paint adhesion is demonstrated utilizing the Ford BI 3-1 Paint Adhesion test. In this test, the zinc-nickel plated panels obtained in Examples I–III are painted with one coat of a commercially available water-reducible enamel and cured. The painted panels are then scribed in an "X" pattern (comer to opposite comer) with a sharp instrument to expose the surface of the underlying metal. The painted and scribed panels are then suspended in a salt fog cabinet, and a 5% sodium chloride solution is sprayed on the panels. About every 24 hours, the panels are removed from the cabinet and dried. An adhesive tape is pressed against the scribed area and thereafter pulled away from the panel. The tape is examined for the presence of any paint. If no paint is found on the adhesive tape, the panel is returned to the cabinet for continued exposure to the salt spray. The length of exposure to the salt spray before paint is observed on the tape is recorded. The results of these tests are summarized in the following Table II.

TABLE II

| Salt Spray Test Results* | |
|---|---|
| Panel of Examples | Hours |
| I | 216, 336 |
| II | 504, 504 |
| III | 792, 1008 |

*Duplicate runs

From the above description, it will be apparent that the advantages which are obtained from this invention include the ability to produce black coating while eliminating the use of chromium and photosensitive silver compounds; the ability to evaluate a black coating and subsequently applied siccative organic coatings by automated optical inspection (AOI); improved corrosion resistance; and good paint adhesion. Another advantage of the method of the invention is the ability to deposit a coating or to modify the zinc-nickel alloy in a manner which results in improved paint adhesion using an acidic solution which is effective at ambient temperatures and does not form any insolubles (sludge) on continued use. In contrast typical metal phosphate baths require high temperatures and develop sludge on continued use.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

I claim:

1. A method of preparing a black zinc-nickel alloy surface wherein the alloy contains at least about 8% by weight of nickel which comprises contacting said zinc-nickel alloy surface with a chromium-free aqueous acidic solution comprising water, from about 1% to about 10% by weight of a phosphorus acid selected from phosphoric acid, phosphorous acid, hypophosphorous acid and mixtures thereof, and from about 0.1% to about 5% by weight of at least one silane characterized by the formula $$(R^1)_a(RO)_{3-a}SiR^2 \qquad \text{(IA)}$$

wherein R and $R^1$ are each independently alkyl groups containing from 1 to about 5 carbon atoms, $R^2$ contains from about 1 to about 10 carbon atoms and one or more functional groups selected from the groups consisting of halogen, vinyl, epoxy, acryl, styryl, amino, carboxyl, amide or sulfonyl groups, and a is an integer of from 0 to 3.

2. The method of claim 1 wherein a=0.

3. The method of claim 2 wherein the phosphorus acid is phosphoric acid or hypophosphorous acid.

4. The method of claim 2 wherein the zinc-nickel alloy contains from about 10% to about 16% by weight of nickel.

5. The method of claim 2 wherein the functional groups in $R^2$ are epoxy or amino groups.

6. The method of claim 2 wherein $R^2$ is characterized by the formula $$-(CH_2)_nNH(CH_2)_mNH_2$$

wherein m and n are independently integers,from 1 to 5.

7. The method of claim 2 wherein each R is a methyl group.

8. The method of claim 1 wherein the solution contains a mixture of a silane of Formula IA and at least one other silane characterized by the formulae $$((R^1)_a(RO)_{3-a}SiR^3)_yN(H)_{3-y} \quad \text{(II)}$$

$$((R^1)_a(RO)_{3-a}Si)_2R^3 \quad \text{(III)}$$

wherein each R is independently an alkyl, aryl, aralkyl or a cycloalkyl group, each $R^1$ is an R group, an alkenyl or fluoride-substituted alkyl group containing less than about 20 carbon atoms, or hydrogen, each $R^3$ is a divalent hydrocarbon or divalent polyether group of less than 20 carbon atoms, a is an integer of from 0 to 3, and y is an integer of from 1 to 3.

* * * * *